US005720250A

United States Patent [19]

Greppmair et al.

[11] Patent Number: 5,720,250

[45] Date of Patent: Feb. 24, 1998

[54] THROTTLE ACTUATING DEVICE FOR INTERNAL COMBUSTION ENGINES WITH DIAPHRAGM CARBURETOR TO BE USED WITH SOIL COMPACTING DEVICES

[75] Inventors: Martin Greppmair; Wolfgang Hausler, both of München, Germany

[73] Assignee: Wacker Werke GmbH & Co. KG, München, Germany

[21] Appl. No.: 782,556

[22] Filed: Dec. 24, 1996

[30] Foreign Application Priority Data

Dec. 29, 1995 [DE] Germany ..... 195 49 113.0

[51] Int. Cl.[6] ..... F02B 77/00

[52] U.S. Cl. ..... 123/198 DB; 123/DIG. 11

[58] Field of Search ..... 123/198 DB, DIG. 11

*Primary Examiner*—Noah P. Kamen

*Attorney, Agent, or Firm*—Robert W. Becker & Associates

[57] ABSTRACT

A throttle actuating device for an internal combustion engine of a soil compacting device, the internal combustion engine having a diaphragm carburetor and a connection between the fuel tank and the diaphragm carburetor, includes a control mechanism for switching the diaphragm carburetor into different operating positions including a full load position, an idle position, an intermediate position, and a turn-off position for the internal combustion engine. The intermediate position is located between the idle position and the turn-off position in the travel path of the control mechanism. The control mechanism, when being moved from the idle position toward the turn-off position, shuts off the connection 32 for interrupting fuel flow from the fuel tank to the diaphragm carburetor when passing through the intermediate position. The control mechanism, when being moved from the turn-off position toward the idle position, opens the connection to allow fuel flow from the fuel tank to the diaphragm carburetor when passing through the intermediate position.

7 Claims, 2 Drawing Sheets

THROTTLE ACTUATING DEVICE FOR INTERNAL COMBUSTION ENGINES WITH DIAPHRAGM CARBURETOR TO BE USED WITH SOIL COMPACTING DEVICES

BACKGROUND OF THE INVENTION

The invention relates to a throttle actuating device for internal combustion engines with diaphragm carburetor to be used with soil compacting devices. The internal combustion engine comprises a connection between the fuel tank and the carburetor that can be closed off. The throttle actuating device comprises a control mechanism for changing the carburetor position as desired into a plurality of switching positions, including a full load position, an idle position, and a turn-off position for the engine.

Four-stroke combustion engines of small size, but also two-stroke combustion engines, are conventionally furnished with float-type carburetors. Float-type carburetors, however, are not suitable for applications in which the combustion engine is often in a slanted position and/or subjected to strong vibrations because this increases the risk of flooding of the carburetor and, furthermore, the carburetor is subjected to great wear. Soil compacting devices are often used in such operating conditions so that their engines are preferably provided with diaphragm carburetors.

Diaphragm carburetors of a simple construction with only one diaphragm for fuel supply control, but also carburetors with an additional second diaphragm for transporting fuel, are much better suited for vibration machinery; however, due to the strong vibrations, but also because of wear and soiling, it cannot be ensured reliably that these carburetors, after shutting down the engine, are absolutely tightly sealed.

Especially for longer work interruptions is thus necessary to reliably close the connection between the fuel tank, often arranged above the carburetor, and the carburetor after shutting down the engine. If this is not done, there is the risk that the engine is flooded as, for example, in the case of a suspended engine where the fuel/oil mixture runs into the cylinder head, or in the case of a supported engine where the mixture will run into the crankcase of the engine.

In both cases the engine is difficult to start because of the flooding with fuel.

It is therefore an object of the present invention to provide a throttle actuating device of the aforementioned kind with which, after shut-down of the motor, the connection between the fuel tank and the carburetor is reliably shut down independent of whether the operator is aware of the fact that upon shutting down the engine the fuel cock, respectively, shut-off device within the fuel line must be moved into its shut-off position.

SUMMARY OF THE INVENTION

The throttle actuating device for an internal combustion engine of a soil compacting device, wherein the internal combustion engine has a diaphragm carburetor and a connection between the fuel tank and the diaphragm carburetor, according to the present invention is primarily characterized by:

A control mechanism for switching the diaphragm carburetor into different operating positions including a full load position, an idle position, an intermediate position, and a turn-off position for the internal combustion engine;

The intermediate position located between the idle position and the turn-off position in the travel path of the control mechanism;

The control mechanism, when being moved from the idle position toward the turn-off position, shutting off the connection for interrupting fuel flow from the fuel tank to the diaphragm carburetor when passing through the intermediate position; and The control mechanism, when being moved from the turn-off position toward the idle position, opening the connection to allow fuel flow from the fuel tank to the diaphragm carburetor when passing through the intermediate position.

Advantageously, the throttle actuating device further comprises a mechanically actuatable shut-off valve mounted within the connection. A mechanical switching connection including a first control element connected to the shut-off valve and a second control element being a part of the control mechanism is provided. The mechanical switching connection further comprises a control curve positioned between the first control element and the second control element for adjustably connecting the first control member to the second control member.

Advantageously, the first control element is biased into a first position in which the shut-off valve is opened and in which the first control element projects into a path of the second control element. The second control element moves the first control element into a second position in which the shut-off valve is closed when the control mechanism is within a locking stroke that includes moving from the idle position to the turn-off position and resting in the turn-off position.

The second control element is a control lever having the control curve, the control lever comprising a control cam being a part of the control curve. The first control element is biased against the control lever in a radial direction relative to a pivot axis of the control lever.

The first control element is biased against an abutment limiting the movement of the first control element in the bias direction thereof and the second control element cooperates with the first control element such that an active connection between the first and second control elements is provided as long as the second control element of the control mechanism is within the locking stroke.

Preferably, the throttle actuating device comprises a shorting key activated by the control mechanism in the turn-off position.

The throttle actuating device may also comprise a switch for interrupting a breaker circuit when the control mechanism is in the turn-off position.

According to the present invention, within the movement path of the control mechanism between the idle position and the turn-off position an intermediate position is arranged and designed such that, upon passing the intermediate position from the idle position in direction toward the turn-off position, the connection between the fuel tank and the carburetor is interrupted and, upon passing the intermediate position in the counter direction, this connection is opened.

With this construction of the engine control the operator only has to operate one single control mechanism whereby the individual switching positions of the control mechanism are arranged in a logical sequence. For a short work interruption, the control mechanism can be moved from the full-load position into the idle position of the carburetor and with an oppositely directed movement of the control mechanism the engine output can be increased again. When it is desired to shut down the engine, the movement of the control mechanism from the full-load position toward the idle position is continued in the same direction past the idle position into the turn-off position. This movement results first in a position in which the shut-off valve within the fuel connection is moved into the closed position so that the engine is shut off when the amount fuel at the carburetor side of the shut-off valve has been consumed. If it is desired to immediately shut down the engine, the movement of the control mechanism is continued in the same direction until the turn-off position is reached where, in a preferred embodiment of the invention, in the path of movement of the control mechanism a shorting key is arranged that is activated by the control mechanism. The same effect can be achieved when, according to another variant of the invention, instead of a shorting key a switch for interrupting the breaker circuit is provided. Since for starting the engine the control mechanism is moved from the turn-off position into the respective operating position, the short circuit is canceled, respectively, the breaker circuit is again switched, the shut-off valve is opened, and the connection between the fuel tank and the carburetor is again opened.

In an advantageous embodiment, the throttle actuating device comprises a mechanically actuatable shut-off valve positioned within the connection between the fuel tank and the carburetor. For actuating the shut-off valve, a suitable mechanical switching connection is provided between the control mechanism and the shut-off valve. It comprises a first control element coordinated with the shut-off valve that is connected via a control curve to a second control element correlated with the control mechanism. According to an advantageous embodiment, the first control element is biased into a position corresponding to the open position of the shut-off valve and, under the effect of this biasing force, projects into the path of the second control element. It is thus forced by the second control element, counter to the biasing force, into a position that corresponds to the shut-off position of the shut-off valve as long as the control mechanism is positioned on a travel path that corresponds to a locking stroke that includes travel from the idle position to the shut-off position and includes resting in this shut-off position.

According to another advantageous variant of the invention, the control mechanism comprises a control lever with control cam on which the first control element, under the effect of the biasing force, rests in a radial direction relative to the pivot axis of the control lever.

Another variant suggests that the first control element, under the effect of the biasing force, rest at an abutment that limits its movement and that the second control element be correlated with the first control element such that an active connection between the two control elements is provided as long as the control mechanism is within the locking stroke.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 4.

Figure 1:
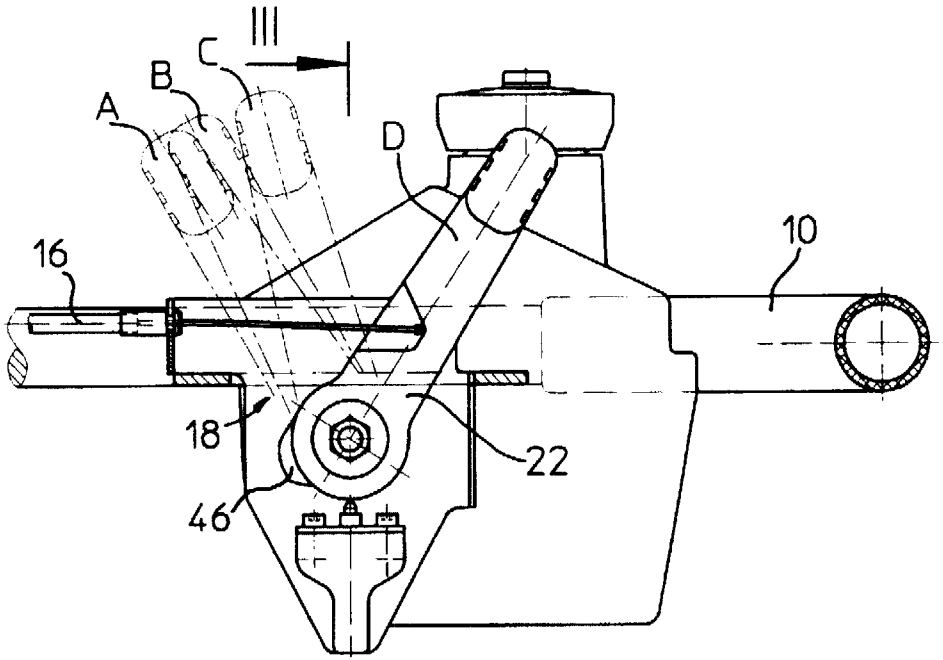
FIG. 1 shows the throttle actuating device of the engine of a soil compacting device in a detailed side view.
Figure 2:
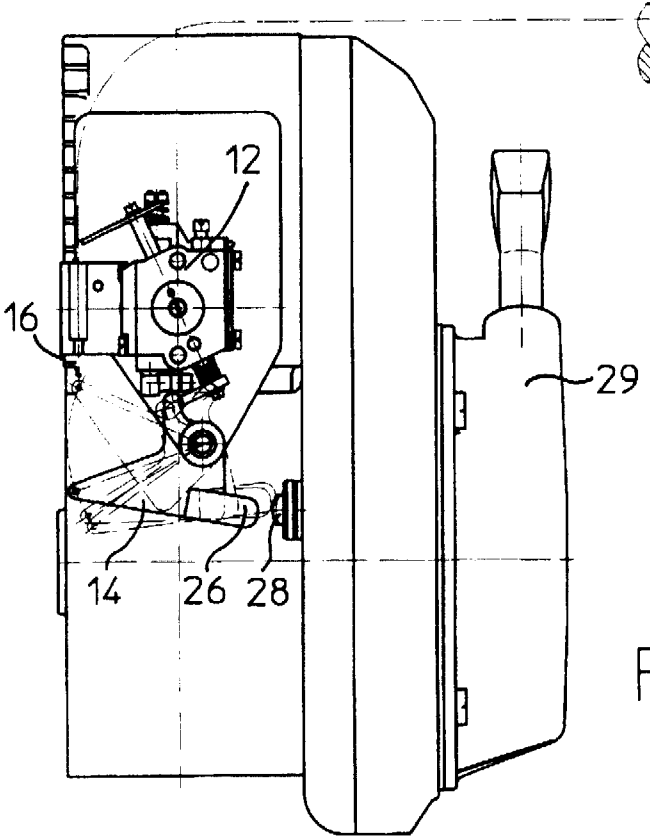
FIG. 2 shows a detail of the engine with carburetor and starting device.
Figure 3:
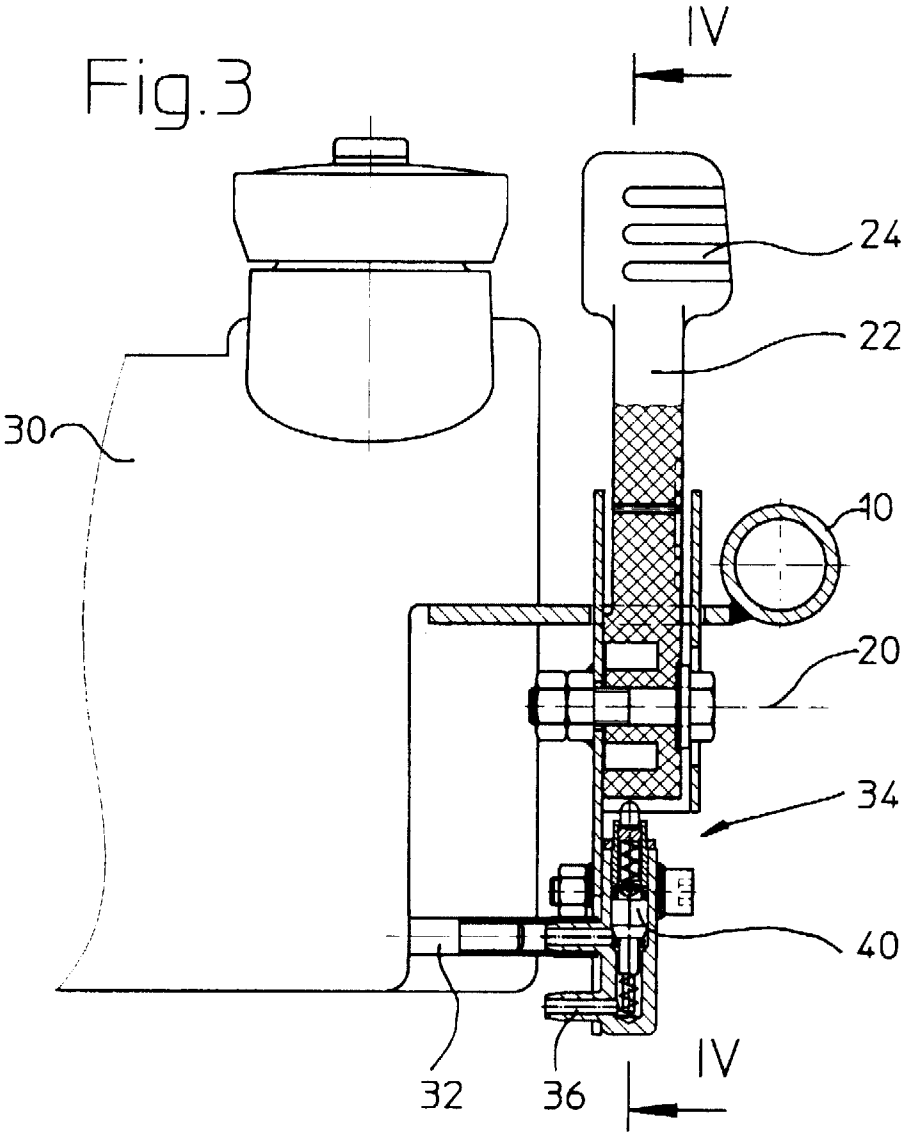
FIG. 3 shows a sectional view along the line III—III of FIG. 1.
Figure 4:
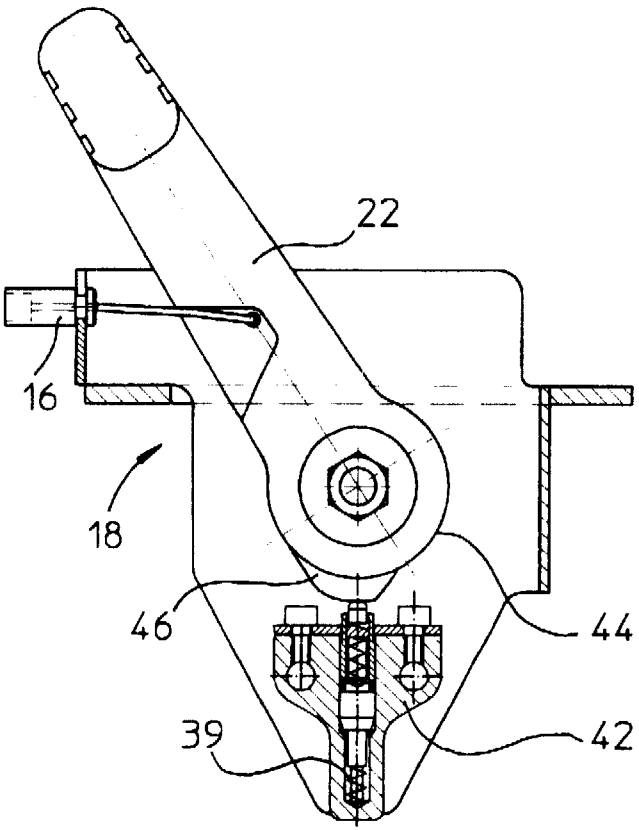
FIG. 4 shows a detail similar to FIG. 1, partly in section along the line IV—IV of FIG. 3.

A soil compacting device 10, which is represented in the drawing only by a tubular part of its frame, is operated with an internal combustion engine for carburetor fuel whereby only the carburetor 12 is shown in FIG. 2 with the throttle being activated by a lever 14. A Bowden cable 16 engages the lever 14. Its other end is connected to a pivotable control lever 22 that can be pivoted about the axis 20 (FIG. 1). Together with the control lever 22 the cable 16 forms the control mechanism 18 for controlling the engine. FIG. 1 shows the control lever 22 in one of its end positions, the full load position D, from where, with the aid of the handle 24 (FIG. 3), it can be moved counter clockwise into the sequentially arranged idle position C, an intermediate position B for shutting off the fuel supply, and into a turn-off position A in which position the engine is turned off immediately by short-circuiting the ignition or by switching the breaker circuit (FIG. 1). The movement of the control lever 22 is transmitted via the Bowden cable 16 which is schematically represented between the control lever 22 and the lever 14 of the throttle by a dash-dotted line in FIGS. 1 and 2.

The lever 14 has an eccentric cam 26 which upon reaching the shut-off position actuates the shorting key 28 so that the engine is immediately turned off.

FIG. 2 shows the starter 29 for the engine.

A fuel line 32 extends from the fuel tank 30 (FIG. 3) to a shut-off valve 34 and from the exit 36 of the valve 34 to the carburetor 12. The shut-off valve 34 comprises a valve slide 40 (the first control element) that is biased by a spring 39 into its open position so that it projects from the valve housing 42 in a radial direction relative to the axis 20 and rests at the control lever 22 (the second control element), respectively, its control curve 44. This control curve 44 comprises a cam-shaped projection 46 which is suitable to force the valve slide 40 counter to the force of the valve spring 39 into its shut-off position when the control lever 22 is moved from the idle position C into the intermediate position B. In the shut-off position of the valve slide 40 the fuel supply of the carburetor 12 from the fuel tank 30 is completely interrupted.

The present invention is, of course, in no way restricted to the specific disclosure of the specification and drawings, but also encompasses any modifications within the scope of the appended claims.

What we claim is:

1. A throttle actuating device for an internal combustion engine of a soil compacting device, the internal combustion engine having a diaphragm carburetor and a connection between a fuel tank and the diaphragm carburetor, said throttle actuating device comprising:

a control mechanism for switching the diaphragm carburetor into different operating positions including a full load position, an idle position, an intermediate position, and a turn-off position for the internal combustion engine;

said intermediate position located between said idle position and said turn-off position in the travel path of said control mechanism;

said control mechanism, when being moved from said idle position toward said turn-off position, shutting off the connection for interrupting fuel flow from the fuel tank to the diaphragm carburetor when passing through said intermediate position; and said control mechanism, when being moved from said turn-off position toward said idle position, opening the connection to allow fuel flow from the fuel tank to the diaphragm carburetor when passing through said intermediate position.

2. A throttle actuating device according to claim 1, further comprising:

a mechanically actuatable shut-off valve mounted within the connection;

a mechanical switching connection including a first control element connected to said shut-off valve and a second control element being a part of said control mechanism;

said mechanical switching connection further comprising a control curve positioned between said first control element and said second control element for adjustably connecting said first control member to said second control member.

3. A throttle actuating device according to claim 2, wherein:

said first control element is biased into a first position in which said shut-off valve is open and in which said first control element projects into a path of said second control element; and said second control element moves said frist control element into a second position in which said shut-off valve is closed when said control mechanism is within a locking stroke that includes moving from said idle position to said turn-off position and resting in said turn-off position.

4. A throttle actuating device according to claim 3, wherein said second control element is a control lever having said control curve, said control lever comprising a control cam being a part of said control curve and wherein said first control element is biased against said control lever in a radial direction relative to a pivot axis of said control lever.

5. A throttle actuating device according to claim 3, wherein said first control element is biased against an abutment limiting a movement of said first control element in a bias direction thereof and wherein said second control element cooperates with said first control element such that an active connection between said first and second control elements is provided as long as said second control element of said control mechanism is within said locking stroke.

6. A throttle actuating device according to claim 1, comprising a shorting key activated by said control mechanism in said turn-off position.

7. A throttle actuating device according to claim 1, comprising a switch for interrupting a breaker circuit when said control mechanism is in said turn-off position.

* * * * *